United States Patent [19]

Kleefeldt

[11] Patent Number: 4,834,435

[45] Date of Patent: May 30, 1989

[54] BOLT ASSEMBLY FOR MOTOR-VEHICLE DOOR LATCH

[75] Inventor: Frank Kleefeldt, Heiligenhaus, Fed. Rep. of Germany

[73] Assignee: Kiekert GmbH & Co., Heiligenhaus, Fed. Rep. of Germany

[21] Appl. No.: 203,245

[22] Filed: Jun. 6, 1988

[30] Foreign Application Priority Data

Jul. 28, 1987 [DE] Fed. Rep. of Germany ... 8710288[U]

[51] Int. Cl.[4] ..... E05C 21/02

[52] U.S. Cl. ..... 292/341.12; 292/DIG. 56; 292/DIG. 73

[58] Field of Search ..... 292/216, 340, 341.12, 292/DIG. 56, DIG. 73

[56] References Cited

U.S. PATENT DOCUMENTS 3,572,797 3/1971 Shay ..... 292/340 X
4,165,112 8/1979 Kleefeldt ..... 292/341.12 X
4,202,571 5/1980 Nishikoori ..... 292/216
4,466,645 8/1984 Kobayashi ..... 292/341.12
4,756,564 7/1988 Ikeda ..... 292/216

*Primary Examiner*—Richard E. Moore
*Attorney, Agent, or Firm*—Herbert Dubno

[57] ABSTRACT

A bolt assembly for a motor-vehicle latch wherein the assembly is secured to a doorpost and coacts with a latch fork according to the invention has a metallic U-shaped yoke having an inner flange adapted to be secured to the doorpost and an outer flange spaced therefrom, forming a fork-receiving space therewith, and having an outer surface turned away from the inner flange. A metallic bolt is fixed to the two flanges and extends generally perpendicularly therebetween. A nonmetallic resilient sleeve surrounds the bolt between the flanges and a nonmetallic cover overlies at least the outer surface of the outer flange.

2 Claims, 2 Drawing Sheets

BOLT ASSEMBLY FOR MOTOR-VEHICLE DOOR LATCH

FIELD OF THE INVENTION

The present invention relates to a motor-vehicle door latch. More particularly this invention concerns the bolt assembly for such a latch.

BACKGROUND OF THE INVENTION

A standard motor-vehicle door latch comprises a bolt attached to and extending perpendicularly from the doorpost and a latch on the door edge. The latch has a pivotal fork that engages around the bolt to secure the door tightly in place.

The bolt is typically part of a bolt assembly comprises of a metallic U-shaped yoke having an inner flange adapted to be secured to the doorpost and an outer flange spaced therefrom, forming a fork-receiving space therewith, and having an outer surface turned away from the inner flange. The bolt is also metallic and is fixed to the two flanges so as to extend generally perpendicularly therebetween.

When the door is closed the outer surface of the outer flange normally contacts the door, and of course the metallic latch fork engages over the metallic bolt. This metal-to-metal contact is noisy, and also leads to abrasion and some damage to the metal, leaving sharp edges.

Thus in addition to the annoyance of noisy operation. the standard prior-art latch assembly normally has to start with or develops sharp edges that can scratch a person using the door or catch on and tear his or her clothing.

OBJECTS OF THE INVENTION

It is therefore an object of the present invention to provide an improved bolt assembly for a motor-vehicle door latch.

Another object is the provision of such a bolt assembly for a motor-vehicle door latch which overcomes the above-given disadvantages, that is which operates quietly and which also does not have or develop possibly harmful sharp edges.

SUMMARY OF THE INVENTION

A bolt assembly for a motor-vehicle latch wherein the assembly is secured to a doorpost and coacts with a latch fork according to the invention has a metallic U-shaped yoke having an inner flange adapted to be secured to the doorpost and an outer flange spaced therefrom, forming a fork-receiving space therewith, and having an outer surface turned away from the inner flange. A metallic bolt is fixed to the two flanges and extends generally perpendicularly therebetween. A nonmetallic resilient sleeve surrounds the bolt between the flanges and a nonmetallic cover overlies at least the outer surface of the outer flange.

Thus with the system of this invention the bolt is cushioned so that it will cooperate with the fork quietly, and the surfaces of the yoke that engage the door edge are similarly cushioned. Even when according to this invention a second sleeve of a material substantially more resistant to wear than the first sleeve surrounds the first-mentioned sleeve the noise that the latch of this invention is substantially reduces. This second sleeve can be of thin sheet metal or of a durable synthetic resin such as a polyamide or polytetrafluorethylene.

The cover according to this invention can either be molded on the yoke or can be a separate element complementarily fitted to the yoke. It also fills the space between the flanges except for a pocket immediately surrounding the bolt for accommodating the fork. The flanges have confronting inner surfaces and the cover overlies these inner surfaces and the sleeve directly abuts the cover adjacent these inner surfaces.

DESCRIPTION OF THE DRAWING

The above and other objects, features, and advantages will become more apparent from the following, reference being made to the accompanying drawing in which.

SPECIFIC DESCRIPTION

Figure 1:
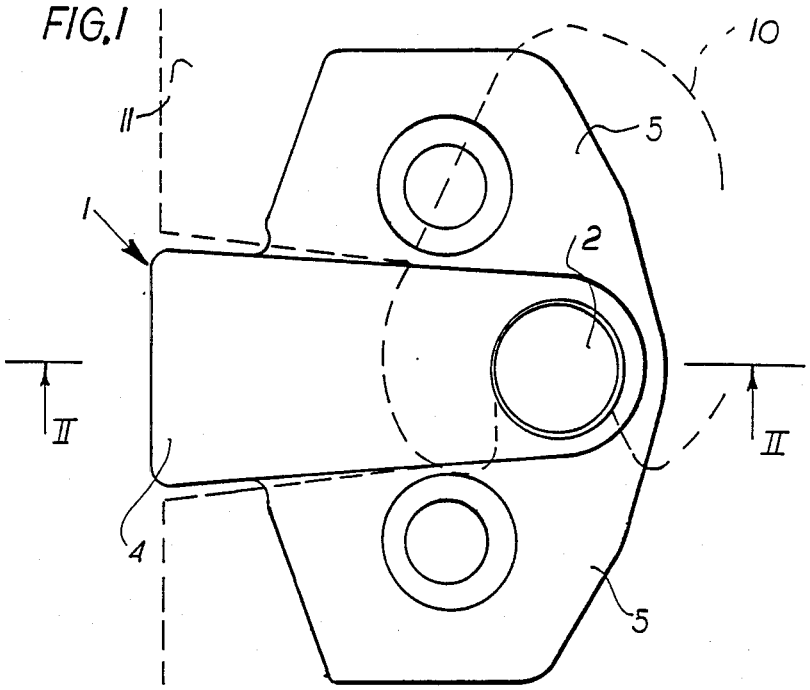
FIG. 1 is a side elevational view of the latch bolt with associated structure indicated in dashed lines.

As seen in FIG. 1 a motor-vehicle-door latch comprises a U-shaped sheet-metal yoke 1 having a pair of flanges 3 and 4 bridged by a standard latch bolt 2 which is here mounted rivet-fashion in these flanges 3 and 4 and extends perpendicutlar to them. The flange 3 extends in its own plane as mounting ears 5 that are bolted directly to the vertical surface of the doorpost indicated schematically at 11 and the bolt 2 is intended to cooperate with a standard pivotal latch fork 10.

Figure 2:
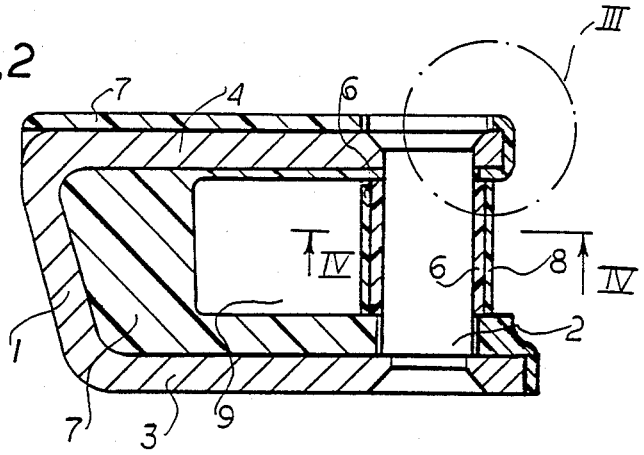
FIG. 2 is a section taken along line II—II of FIG. 1.
Figure 3:
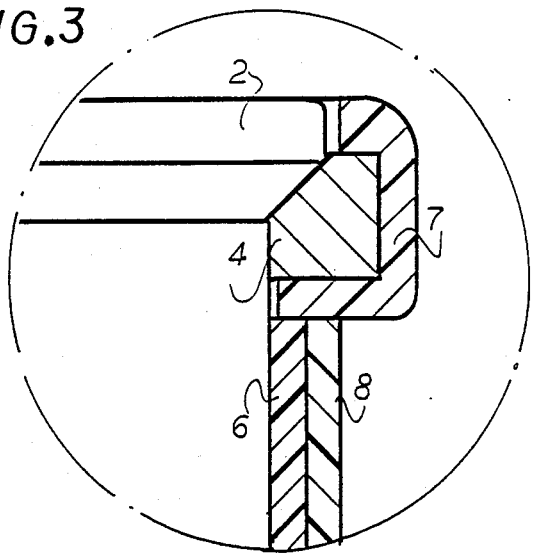
FIG. 3 is a large-scale view of a the detail indicated at III in FIG. 2.
Figure 4:
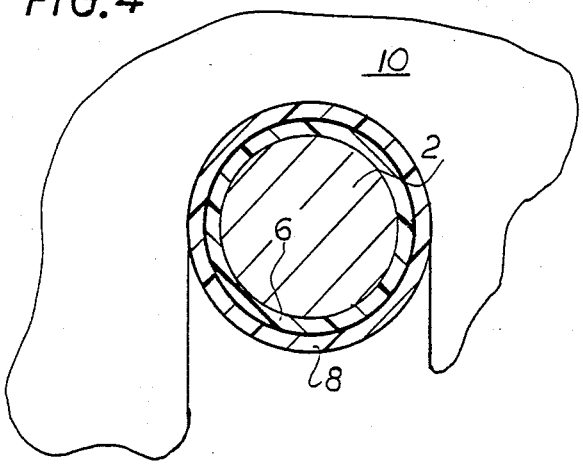
FIG. 4 is a section taken along line IV—IV of FIG. 2.

According to this invention as seen in FIG. 2 through 4 the steel bolt 2, which is effectively integral with the steel yoke 1, is provided with an elastomerically resilient cover sleeve 6. In addition at this wear-prone region this sleeve 6 is in turn covered by a somewhat harder wear sleeve 8, for instance of a metal or a synthetic resin such as polyamide or polytetrafluorethylene.

In addition the yoke 1 is fitted with a synthetic-resin cover 7 which fits complementarily over its exposed flange 4 and which fills its interior except for a pocket 9 left to acommodate the fork 10. This cover/filler 7 can be molded right to the yoke 1, but normally is a separate element that is fitted to it.

the bolt unit of this invention is assembled by first fitting or molding the cover/filler 7 to the yoke 1. Then the sleeves 6 and 8 are positioned and the bolt 2 is fitted through, normally from the side of the flange 4, and is spread at the post flange 3. The entire unit is then bolted to the doorpost 11, it being noted that the flange 3 is not covered externally by the cover 7 so that a solid metal-to metal connection is made here.

I claim:

1. A bolt assembly for a motor-vehicle latch wherein the assembly is secured to a doorpost and coacts with a latch fork, the assembly comprising:

a metallic U-shaped yoke having an inner flange adapted to be secured to the doorpost and an outer flange spaced therefrom, forming a fork-receiving space therewith, and having an outer surface turned away from the inner flange;

a metallic bolt fixed to the two flanges and extending gaenerally perpendicularly therebetween;

a nonmetallic resilient sleeve surrounding the bolt between the flanges; and a nonmetallic cover overlying at least the outer surface of the outer flange, the cover also filling the space between the flanges except for a pocket immediately surrounding the bolt for accommodating the fork.

2. A bolt assembly for a motor-vehicle latch wherein the assembly is secured to a doorpost and coacts with a latch fork, the assembly comprising:

a metallic U-shaped yoke having an inner flange adapted to be secured to the doorpost and an outer flange spaced thereform, forming a fork-receiving space therewith, and having an outer surface turned away from the inner flange;

a metallic bolt fixed to the two flanges and extending generally perpendicularly therebetween;

a nonmetallic resilient sleeve surrounding the bolt between the flanges; and a nonmetallic cover overlying at least the outer surface of the outer flange, the flanges having confronting inner surfaces and the cover overlies these inner surfaces, the sleeve directly abutting the cover adjacent these inner surfaces.

* * * * *